US009302154B2

(12) United States Patent
Steck et al.

(10) Patent No.: US 9,302,154 B2
(45) Date of Patent: Apr. 5, 2016

(54) CAMMING DEVICE STEM

(71) Applicants: Jeremy Andrew Steck, Salt Lake City, UT (US); Breandan Perkins, Salt Lake City, UT (US); Samuel Goodrich Lacey, Park City, UT (US); Bill Belcourt, Salk Lake City, UT (US); Jacob Hall, Draper, UT (US); Joseph Benjamin Walker, Draper, UT (US); Kent Lansing Dodge, Salt Lake City, UT (US)

(72) Inventors: Jeremy Andrew Steck, Salt Lake City, UT (US); Breandan Perkins, Salt Lake City, UT (US); Samuel Goodrich Lacey, Park City, UT (US); Bill Belcourt, Salk Lake City, UT (US); Jacob Hall, Draper, UT (US); Joseph Benjamin Walker, Draper, UT (US); Kent Lansing Dodge, Salt Lake City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 257 days.

(21) Appl. No.: 13/917,390

(22) Filed: Jun. 13, 2013

(65) Prior Publication Data

US 2013/0334385 A1 Dec. 19, 2013

Related U.S. Application Data

(60) Provisional application No. 61/660,094, filed on Jun. 15, 2012.

(51) Int. Cl.
*A47F 5/08* (2006.01)
*A63B 29/02* (2006.01)

(52) U.S. Cl.
CPC ..... *A63B 29/024* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 4,184,657 | A | * | 1/1980 | Jardine | 248/231.9 |
| 4,513,641 | A | * | 4/1985 | Murray et al. | 81/486 |
| 4,565,342 | A | * | 1/1986 | Grow | 248/231.9 |
| 4,572,464 | A | * | 2/1986 | Phillips | 248/231.9 |
| 4,643,377 | A | * | 2/1987 | Christianson | 248/231.9 |
| 4,645,149 | A | * | 2/1987 | Lowe | 248/231.9 |
| 4,715,568 | A | * | 12/1987 | Best, Jr. | 248/231.9 |
| 4,781,346 | A | * | 11/1988 | Banner | 248/231.9 |
| 4,832,289 | A | | 5/1989 | Waggoner | |
| 4,923,160 | A | | 5/1990 | Waggoner | |
| 4,949,927 | A | | 8/1990 | Madocks et al. | |
| 5,484,132 | A | * | 1/1996 | George et al. | 248/231.9 |
| 5,860,629 | A | * | 1/1999 | Reed | 248/231.9 |
| 6,010,171 | A | * | 1/2000 | Margiottiello | 294/94 |
| 6,042,069 | A | * | 3/2000 | Christianson | 248/231.9 |

(Continued)

FOREIGN PATENT DOCUMENTS

EP 1557201 7/2005

*Primary Examiner* — Monica Millner
(74) *Attorney, Agent, or Firm* — Trent Baker; Baker & Hostetler PLLC

(57) ABSTRACT

One embodiment of the present invention relates to an active camming device including a head member, a set of cam lobes, a connection system, and a retraction system. The cam lobes are configured to rotate between a retracted state and a spring biased extended state. The connection system includes a lengthwise cable coupled to the terminal. The retraction system is uniquely configured to enable selective engagement of the retracted state of the cam lobes with respect to the cam head. The retraction system includes slidably externally coupling a trigger and retraction sleeve to the cam lobes over the cable. A set of independent sleeves are also slidably coupled to the cable over the retraction sleeve between the trigger and cam lobes. The independent sleeves may be conically shaped and oriented to adjacently internest with one another so as to protect the retraction sleeve during operation of the refraction system.

20 Claims, 6 Drawing Sheets

(56) References Cited

U.S. PATENT DOCUMENTS

| | | | | |
|---|---|---|---|---|
| 6,092,773 | A * | 7/2000 | Kieliszewski | 248/231.9 |
| 6,109,578 | A * | 8/2000 | Guthrie et al. | 248/231.9 |
| 6,250,175 | B1 | 6/2001 | Noetzold | |
| 6,283,426 | B1 * | 9/2001 | Guthrie et al. | 248/231.9 |
| 6,375,139 | B1 * | 4/2002 | Murray et al. | 248/231.9 |
| 6,606,921 | B2 | 8/2003 | Noetzold | |
| 6,729,821 | B2 * | 5/2004 | Guthrie et al. | 411/80 |
| 6,736,359 | B2 * | 5/2004 | Murray | 248/231.9 |
| 7,014,156 | B2 * | 3/2006 | Apezetxea et al. | 248/231.9 |
| 7,040,588 | B2 * | 5/2006 | Lowe | 248/231.9 |
| 7,055,656 | B2 | 6/2006 | Drew | |
| 7,258,316 | B2 * | 8/2007 | Reeves | 248/231.91 |
| 7,278,618 | B2 * | 10/2007 | Tusting et al. | 248/231.9 |
| 8,317,145 | B2 * | 11/2012 | Reed | 248/231.9 |
| 2002/0162927 | A1 * | 11/2002 | Brown | 248/231.9 |
| 2003/0057337 | A1 | 3/2003 | Brown | |
| 2004/0035992 | A1 * | 2/2004 | Watts | 248/231.9 |
| 2005/0037023 | A1 * | 2/2005 | Field, Jr. | 424/195.15 |
| 2005/0161565 | A1 * | 7/2005 | Tusting et al. | 248/231.9 |
| 2005/0218282 | A1 * | 10/2005 | Phillips | 248/231.9 |
| 2006/0231708 | A1 * | 10/2006 | Robertson et al. | 248/231.9 |
| 2009/0134294 | A1 * | 5/2009 | Hemsley | 248/231.9 |
| 2011/0225793 | A1 | 9/2011 | Daniels | |

* cited by examiner

CAMMING DEVICE STEM

RELATED APPLICATIONS

This application claims priority to U.S. provisional application Ser. No. 61/660,094 filed Jun. 15, 2012, the contents of which are incorporated by reference.

FIELD OF THE INVENTION

The invention generally relates to active camming devices. In particular, the present invention relates to improved retraction system configurations.

BACKGROUND OF THE INVENTION

Climbers generally use clean protection devices for two distinct purposes. First, a clean protection device may be used as a form of safety protection for protecting a climber in the event of a fall and second, a clean protection device may intentionally be used to artificially support a climber's weight. Clean protection devices cam or wedge into a crack, hole, gap, orifice, taper, or recess in order to support an outward force. The surface on which the clean protection device supports the outward force is considered the protection surface. The protection surface can consist of natural materials such as rock or may consist of artificial materials such as concrete or wood.

Clean protection devices are generally divided into the categories active and passive. Passive protection devices include a single object, which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable objects that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection is camming devices. These devices translate rotational displacement into linear displacement. Therefore, a slider chock would not be an active camming device because the two wedges simply slide relative to one another and do not rotate. Camming devices include two, three, and four cam lobe devices. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

One of the problems with active camming devices relates to operation of the connection and retraction system. The connection system interconnects the cam head, cam lobes, and connection point of an active camming device. The connection system includes the stem region between the cam head and cam lobes and the trigger and connection point. The connection system must maintain structural integrity of the entire camming system while enabling flexibility to articulate around objects during operation. The retraction system selectively enables the cam lobes to rotate between the extended and retracted states with respect to the cam head. The retraction system may include various wires/cables extending along the stem region so as to enable the trigger to selectively engage the refracted state of the cam lobes. The connection and retraction system designs of conventional active camming devices generally decrease durability in an effort to increase operational performance. For example, one type of conventional retraction system includes externally extending retraction wires along the stem region between the cam lobes or yoke and the trigger to provide improved performance. The exposed wires enable substantially independent cam lobe operation at the expense of potential wire abrasion damage. Other conventional retraction systems utilize an exposed sleeve coupled between the cam lobes and trigger at expense of operational flexibility. The exposed sleeve provides improved durability over the exposed wires/cables at the expense of operational performance because the retraction system will likely be impeded if it articulates around or over an object.

Therefore, there is a need in the industry for an improved connection and retraction system that efficiently maintains optimal performance and durability.

SUMMARY OF THE INVENTION

The invention generally relates to active camming devices. One embodiment of the present invention relates to an active camming device including a head member, a set of cam lobes, a connection system, and a retraction system. The head member includes a terminal and an axle around which the cam lobes are rotatably coupled. The cam lobes are configured to rotate between a retracted state and a spring biased extended state. The connection system includes a lengthwise cable coupled to the terminal. The retraction system is uniquely configured to enable selective engagement of the retracted state of the cam lobes with respect to the cam head. The retraction system includes slidably externally coupling a trigger and retraction sleeve to the cam lobes over the cable. A set of independent sleeves are also slidably coupled to the cable over the retraction sleeve between the trigger and cam lobes. The independent sleeves may be conically shaped and oriented to adjacently internest with one another so as to protect the refraction sleeve during operation of the retraction system. A second embodiment of the present invention relates to a method for retracting a plurality of cam lobes with respect to the cam head on an active camming device.

Embodiments of the present invention represent a significant advance in the field of active camming devices. As discussed above, conventional active camming devices include retraction systems that either expose portions to unnecessary wear or function suboptimally due to obstruction during operation. Embodiments of the present invention overcome these limitations by incorporating a retraction system with a concealed retraction sleeve coupled between the trigger and the cam lobes. The retraction sleeve is slidably coupled over the cable and externally shielded by a set of independent sleeves. The independent sleeves substantially shield the retraction sleeve from obstruction during operation. The independent sleeves are configured to independently articulate with respect to one another so as to enable the stem region to bend over obstructions. Since the retraction sleeve is slidably disposed between the cable and the independent sleeves, it is not pinched and thereby prevented from translation if an external object exerts a force upon the stem region and independent sleeves during operation. This allows the retraction system to be both durable and provide optimal operational performance.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The invention generally relates to active camming devices. One embodiment of the present invention relates to an active camming device including a head member, a set of cam lobes, a connection system, and a retraction system. The head member includes a terminal and an axle around which the cam lobes are rotatably coupled. The cam lobes are configured to rotate between a retracted state and a spring biased extended state. The connection system includes a lengthwise cable coupled to the terminal. The retraction system is uniquely configured to enable selective engagement of the retracted state of the cam lobes with respect to the cam head. The retraction system includes slidably externally coupling a trigger and retraction sleeve to the cam lobes over the cable. A set of independent sleeves are also slidably coupled to the cable over the retraction sleeve between the trigger and cam lobes. The independent sleeves may be conically shaped and oriented to adjacently internest with one another so as to protect the refraction sleeve during operation of the retraction system. A second embodiment of the present invention relates to a method for retracting a plurality of cam lobes with respect to the cam head on an active camming device. Also, while embodiments are described in reference to an active camming device, it will be appreciated that the teachings of the present invention are applicable to other areas, including but not limited to partially active camming devices and passive camming devices.

The following terms are defined as follows:

Internest—refers to a partial three dimensional overlapping or engagement between adjacent members. For example, two adjacent members may interconnect via some form of three dimensional overlapping structure including but not limited to a male-female type overlapping. Two adjacent conically shaped members may therefore internest with one another by orienting the tip of one conically shaped member to be substantially adjacent to the bottom of the other conically shaped member.

Figure 1:
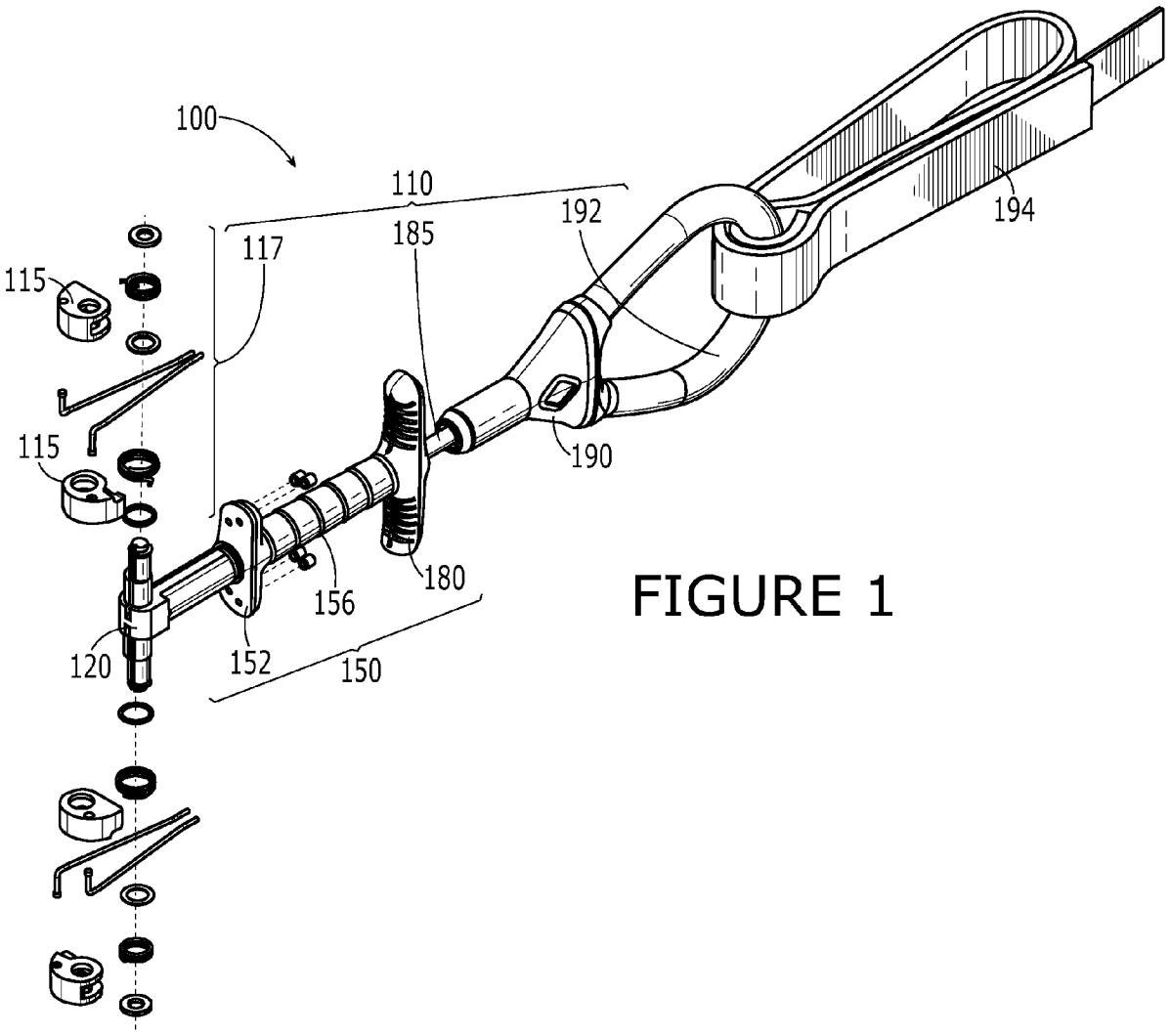
FIG. 1 illustrates a perspective exploded view of an active camming device in accordance with embodiments of the present invention.

Reference is initially made to FIG. 1, which illustrates an active camming device in accordance with embodiments of the present invention, designated generally at 100. The active camming device 100 includes a head member 120, a plurality of cam lobes 115, a connection system 110, and a retraction system 150. The head member 120 includes a terminal and an axle. The axle is configured to rotatably couple with the plurality of cam lobes 115 between an extended state and a retracted state (see FIGS. 3-6). The connection system 110 is configured to provide structural integrity to the system 100 and includes the cam lobe couplers 117, the cable 185, and the connection point 192. It will be appreciated that alternative connection systems may be utilized in accordance with embodiments of the present invention, including but not limited to dual stem configurations. The connection point 192 may be any type of opening including a loop of the cable 185 or an independent member fixably coupled to the end of the cable 185. The retraction system 150 is configured to enable a user to selectively engage the retracted state of the cam lobes 115 with respect to the terminal head 120. The system 100 further includes a sling 194. In operation, a user may retract the cam lobes 115 with the retraction system 150 by exerting a retraction force on the trigger 180 with respect to the thumb rest 190.

Figure 2:
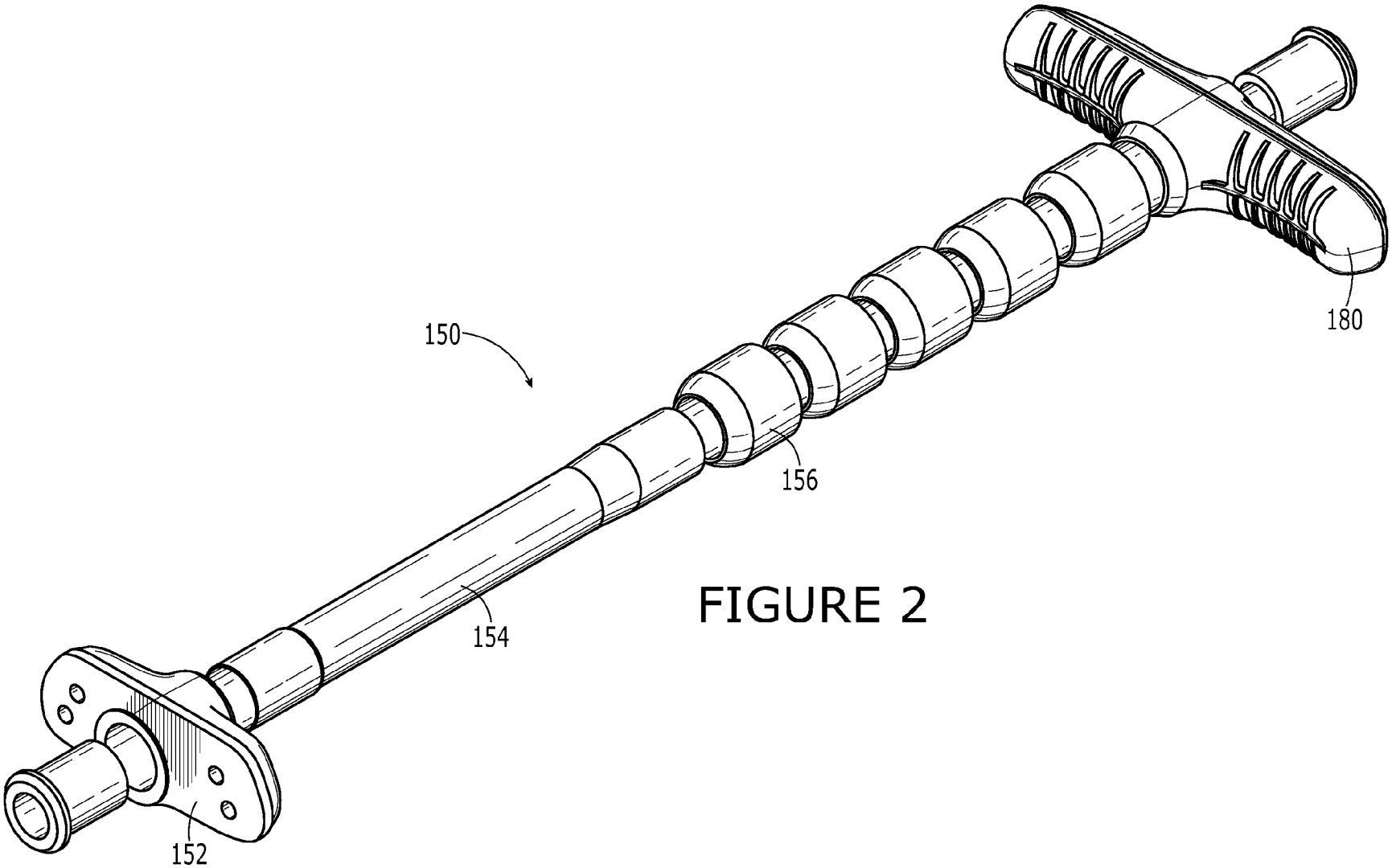
FIG. 2 illustrates a perspective exploded view of the retraction system of the active camming device illustrated in FIG. 1.

Reference is next made to FIG. 2, which illustrates the retraction system illustrated in FIG. 1, designated generally at 150. As discussed above, the retraction system 150 is configured to enable a user to selectively engage the retracted state of the cam lobes 115 with respect to the cam head 120. The illustrated retraction system 150 embodiment includes a yoke 150, a retraction sleeve 154, a plurality of independent sleeves 156, and a trigger 180. The yoke 152 is an optional component fixably coupled to the cam lobes 115 via some form of cable/wires as illustrated in FIG. 3-6. The retraction sleeve 154 is a lengthwise cylindrically shaped hollow member. The retraction sleeve 154 may be composed of a material that enables lengthwise translation including but not limited to plastic, mesh, metal, etc. The retraction sleeve 154 is fixably coupled to the yoke 152 and the trigger 180. The trigger 180 is a substantially T-shaped member with a hollow cylindrical opening. The yoke 152, retraction sleeve 154, and trigger 180 are fixably intercoupled with one another and slidably coupled over the cable 185 of the connection system 110. Therefore, a translation of the trigger 180 with respect to the cable 185 will cause the retraction sleeve 154 and yoke 152 to correspondingly translate with respect to the cable 185. It will be appreciated that the trigger 180, retraction sleeve 154, and yoke 152 may partially translate under certain circumstances. For example, if a user specifically refracts only one side of the trigger 180, the corresponding portions of the retraction sleeve 154 may independently translate, causing the corresponding side of the yoke 152 to also translate. This effectively enables an independent articulation of the cam lobes 115. The retraction sleeve 154 may also create a torsional bias between the trigger 180 and the yoke 152 so as to maintain proper alignment. The mesh sleeve 154 may be composed of a mesh material to further enable partial refraction via portions of the mesh. The retraction sleeve 154 may additionally be configured so as to not exert any substantial form of lengthwise bias on the cable 185 so as to enable a lengthwise unbiased bending or articulation during operation.

The plurality of independent sleeves 156 are individual substantially cylindrically shaped members disposed adjacent to one another between the trigger 180 and the yoke 152. The number and size of the independent sleeves 156 may be configured to cover the region between the trigger 180 and yoke 152. The independent sleeves 156 each contain an internal recess which may be conically shaped and have a minimum diameter corresponding to the size of the combined diameter of the cable 185 and retraction sleeve 154. The internal recess of each independent sleeve 156 may have a wider internal side and a narrower internal side corresponding to the at least partial internal conical shape of the internal recess. The independent sleeves 156 are slidably coupled over the retraction sleeve 154 and cable 185 such that the independent sleeves 156 may translate and articulate with respect to the cable 185 independent of the retraction sleeve 154. The individual sleeves 156 may also be at least partially externally conically shaped and have an external wider side and an external narrower side. The wider external side may overlap or correspond to the wider internal side of each of the independent sleeves 156 to enable a sequential continuous interesting configuration of the plurality of independent sleeves 156 between the yoke 152 and trigger 180. The at least partial conical shape of the internal recess is also configured to geometrically correspond to the at least partial external conical shape of the independent sleeves 156 to enable a partial male/female internested configuration. The internested configuration includes orienting the narrower external side of each of the independent sleeves 156 to the wider internal side of the adjacent independent sleeve, thereby partially internesting or overlapping the sleeves within one another by a particular amount. The amount of internesting corresponds to the at least partially conical external shape and at least partially conical shaped internal recess of the independent sleeves 156. The length of internesting or overlapping may be less than half the lengthwise length of each of the independent sleeves 156.

In operation, the internesting configuration enables the independent sleeves 156 to cover/shield the retraction sleeve 154 at a plurality of articulation angles of the cable 185. For example, during operation of the active camming device system 100, the cable 185 may be forced to articulate/bend at 60 degrees over an object. The shape and internesting configuration of the independent sleeves 156 will maintain coverage of the retraction sleeve 154, thereby protecting the cable 185 and retraction sleeve 154 from damage and/or abrasion. The internested conical shape of the independent sleeves 156 will cause a portion/side of one or more adjacent sleeves 156 to compress towards one another at the point of articulation of the cable 185. This will also have the effect of expanding the opposite side of the adjacent sleeves 156. Therefore, the independent sleeves 156 may independently bend with the cable 185 so as to maintain coverage of the retraction sleeve 154. The amount of internesting or overlap between the adjacent independent sleeves 156 also corresponds to the maximum operational articulation angle of the cable 185, which may maintain substantial coverage of the retraction sleeve 154 by the plurality of independent sleeves 156. In addition, the slidable coupling configuration of the independent sleeves 156 will enable the retraction sleeve 154 to at least partially translate with respect to the cable 185 in circumstances in which the cable 185 is articulated lengthwise over an obstruction. Therefore, the lateral force exerted upon the independent sleeves 156 by the obstruction will not have the effect of completely binding or resisting the translation of the retraction sleeve 154 with respect to the cable 185. Therefore, the performance of the retraction system 150 is not compromised in such an operational scenario.

Figure 3:
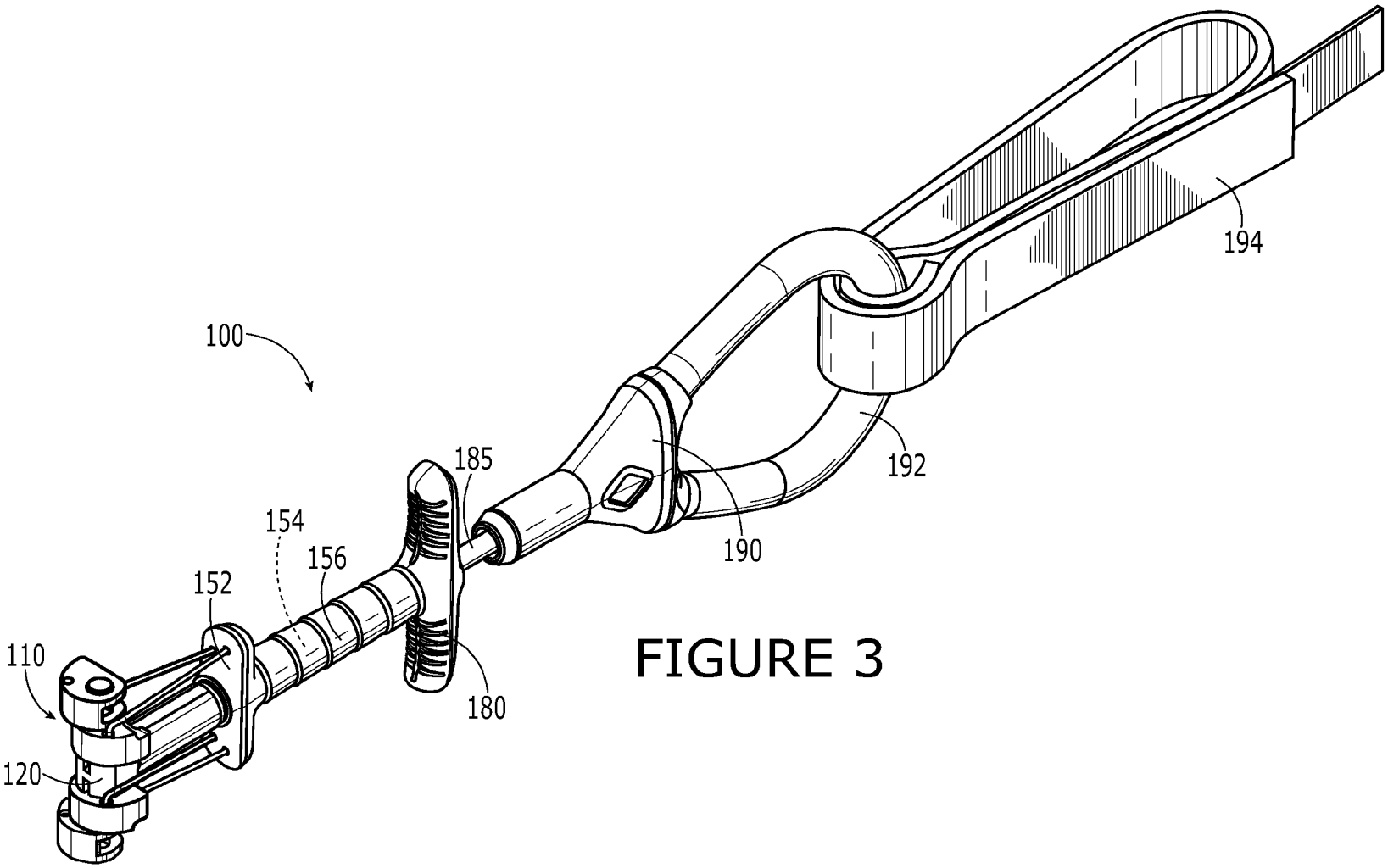
FIG. 3 illustrates a perspective view of the active camming device illustrated in FIG. 1 in the extended state.
Figure 4:
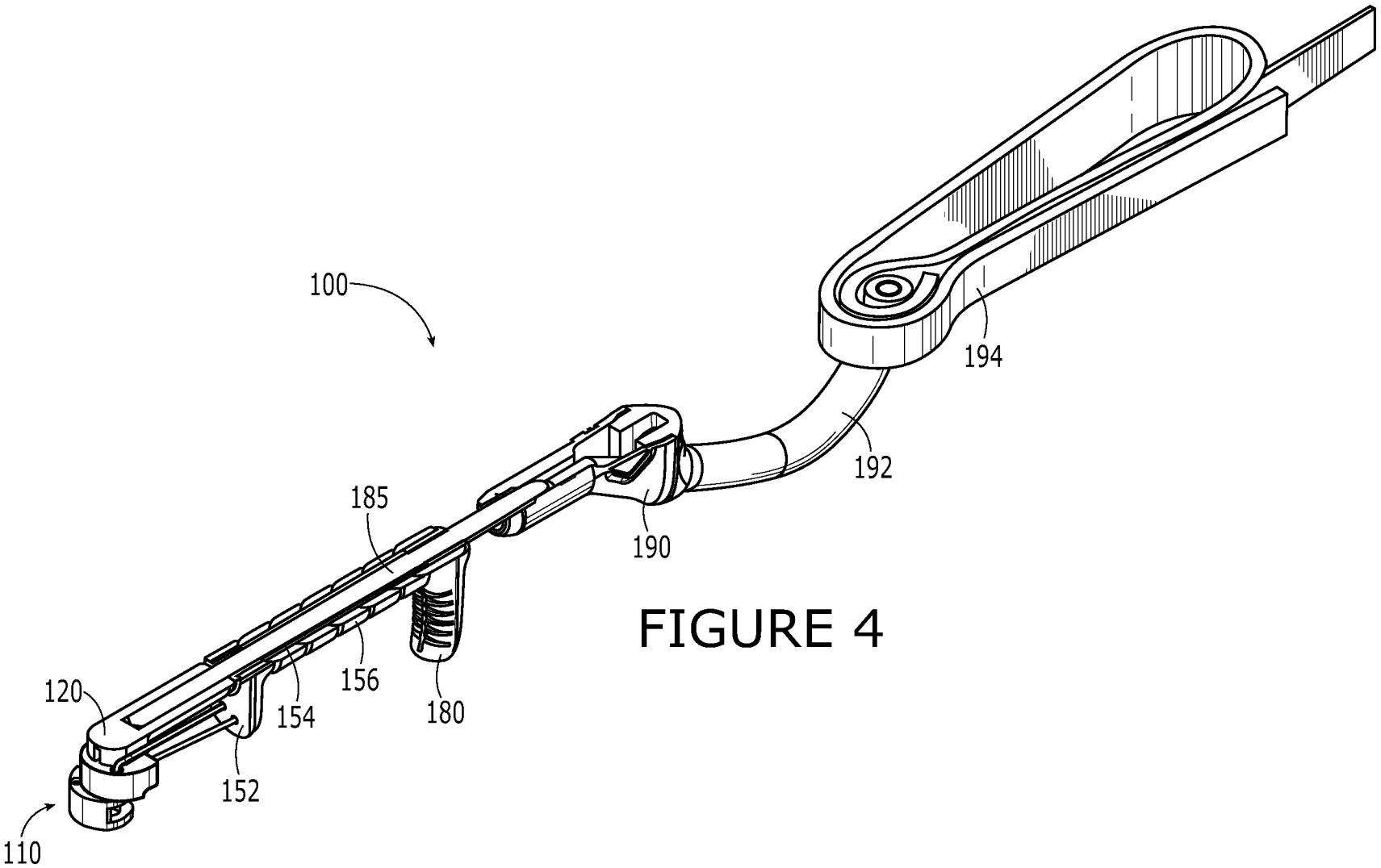
FIG. 4 illustrates a cross-sectional perspective view of the active camming device illustrated in FIG. 1 in the extended state.
Figure 5:
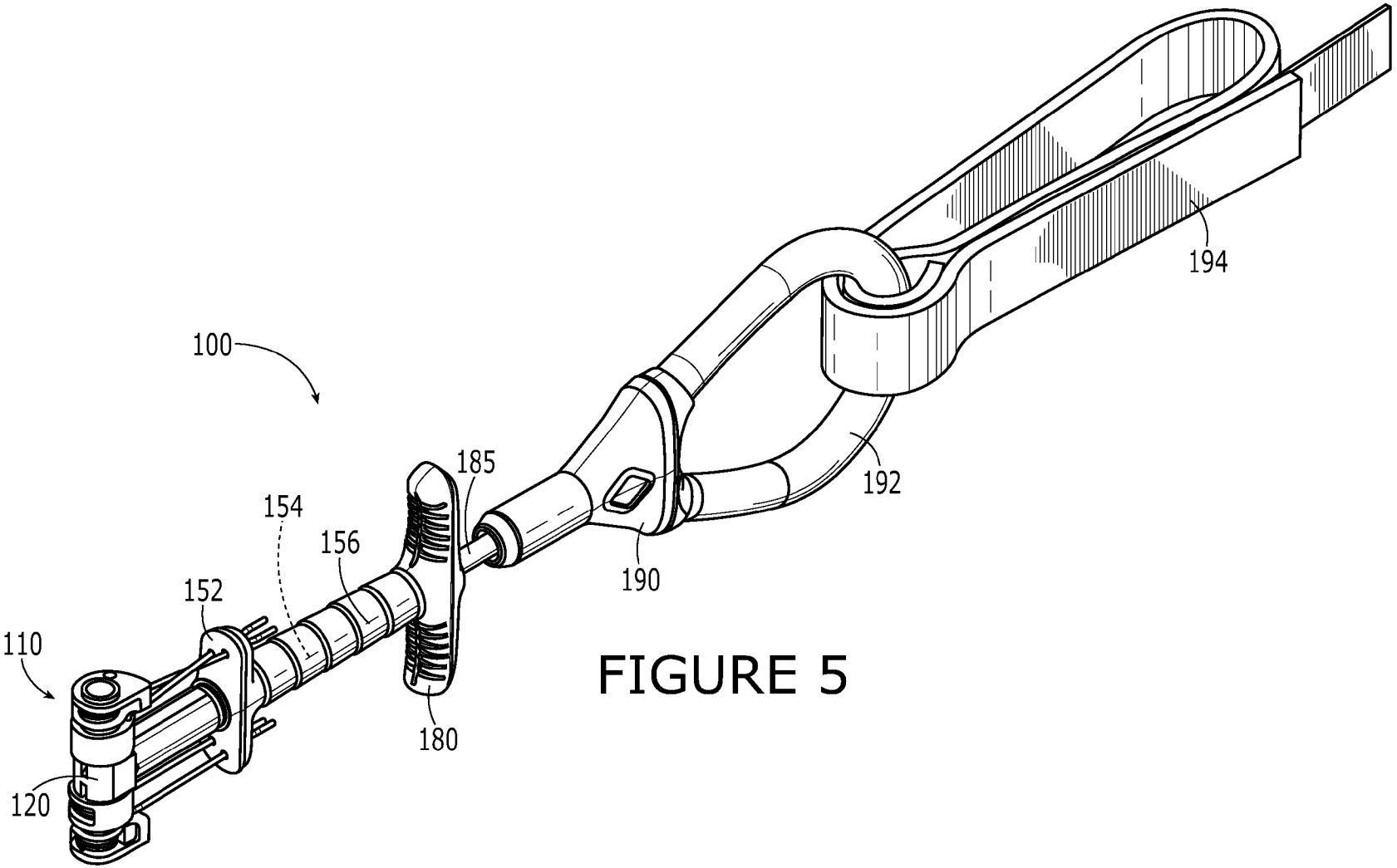
FIG. 5 illustrates a perspective view of the active camming device illustrated in FIG. 1 in the retracted state.
Figure 6:
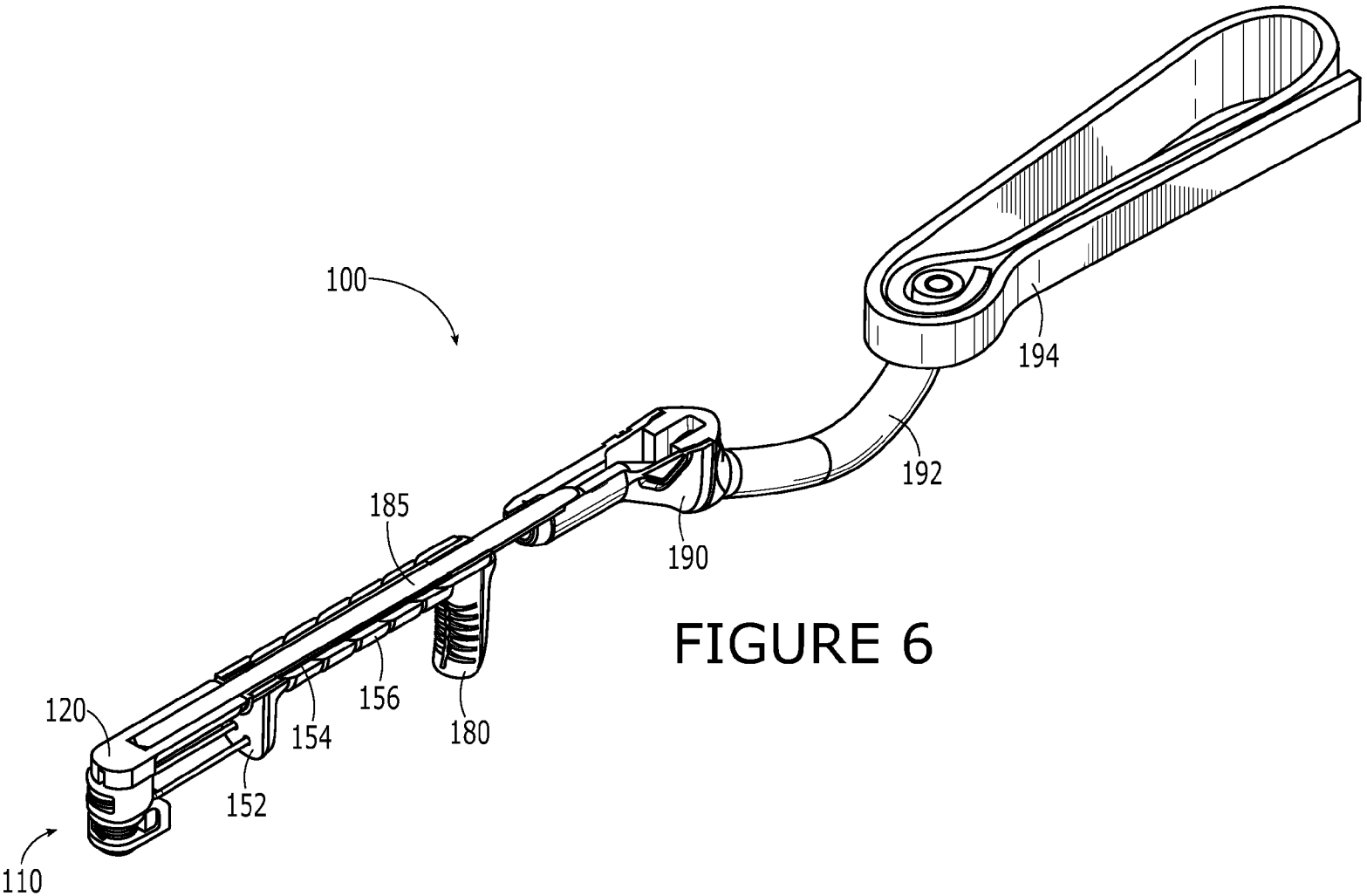
FIG. 6 illustrates a cross-sectional perspective view of the active camming device illustrated in FIG. 1 in the retracted state.

Reference is next made to FIG. 3-6 which illustrate operational and corresponding cross-sectional views of the active camming device of FIG. 1. FIGS. 3 and 4 illustrate perspective and cross-sectional views of the active camming device system of FIG. 1 in the expanded state. The extended state may refer to a default or biased position in which the cab lobes 120 are biased via the connection system 110 into the illustrated rotational orientation on the terminal head 120. FIGS. 5 and 6 illustrate perspective and cross-sectional view of the active camming device of FIG. 1 in the retracted state. The retracted state may refer to a state in which a user exerts a particular retraction force upon the trigger 180 with respect to the thumb rest 190 thereby causing the cam lobes to overcome a biasing force and rotate with respect to the terminal head 120.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An active camming device comprising:

a head member comprising a terminal and an axle;

a plurality of cam lobes rotatably coupled to the axle, wherein the plurality of cam lobes are rotatable between an extended state and a retracted state with respect to the axle, and wherein the cam lobes are spring biased toward the extended state;

a connection system configured to fixably intercouple the terminal with a cable, wherein the cable includes a connection point disposed on a lengthwise end opposite the terminal;

a retraction system configured to selectively engage the retracted state, wherein the retraction system includes fixably coupling the plurality of cam lobes with a retraction sleeve and a trigger, and wherein the retraction sleeve and trigger are slidably externally coupled to the cable; and wherein the retraction system includes a plurality of independent sleeves slidably externally coupled to the cable between the plurality of cam lobes and the trigger, and wherein the plurality of independent sleeves are slidable and external with respect to the retraction sleeve, and wherein the plurality of independent sleeves substantially externally cover the retraction sleeve.

2. The system of claim 1, wherein the plurality of independent sleeves include an at least partially conically shaped external surface, an at least partially conically shaped internal recess, and wherein the plurality of independent sleeves are oriented in an adjacently internested configuration with respect to one another.

3. The system of claim 1, wherein the plurality of independent sleeves include a conically shaped internal recess with an internal large and small end, and wherein the plurality of independent sleeves are oriented in an adjacently internested configuration including orienting the internal large end of each of the independent sleeves adjacent to the internal small end of the adjacent independent sleeve.

4. The system of claim 3, wherein the plurality of independent sleeves include an external conically shaped surface.

5. The system of claim 4, wherein the external conically shaped surface of each of the independent sleeves includes an external large and small end, and wherein the external large end is oriented with the internal large end.

6. The system of claim 4, wherein the external conically shaped surface includes a cylindrically shaped region and a conically shaped region, and wherein the cylindrically shaped region includes the external large end and the internal large end.

7. The system of claim 5, wherein the external small end of the external conically shaped surface corresponds to the internal large end of the internal conically shaped recess in a male-female relation.

8. The system of claim 2, wherein the adjacently internested configuration of the plurality of independent sleeves includes lengthwise overlapping the independent sleeves by at least 5%.

9. The system of claim 2, wherein the adjacently internested configuration of the plurality of independent sleeves includes lengthwise overlapping the adjacent independent sleeves so as to maintain overlapping at an adjacent sleeve lengthwise orientation angle up to 45 degrees.

10. The system of claim 2, wherein the adjacently internested configuration of the plurality of independent sleeves includes a ball and socket coupling including a partially spherically shaped external surface on one end of each sleeve internested within a partially spherical recess within an adjacent independent sleeve.

11. The system of claim 2, wherein the plurality of independent sleeves are substantially frictionless with respect to the retraction sleeve.

12. The system of claim 11, wherein the plurality of independent sleeves, retraction sleeve, and cable are lengthwise bendable across a plurality of angles.

13. The system of claim 11, wherein the plurality of independent sleeves are translatably substantially frictionless with respect to the retraction sleeve and the cable across the plurality of angles.

14. A method for retracting the cam lobes of an active camming device comprising the acts of:

providing an active camming device comprising:

a head member comprising a terminal and an axle;

a plurality of cam lobes rotatably coupled to the axle, wherein the plurality of cam lobes are rotatable between an extended state and a retracted state with respect to the axle, and wherein the cam lobes are spring biased toward the extended state;

a connection system configured to fixably intercouple the terminal with a cable, wherein the cable includes a connection point disposed on a lengthwise end opposite the terminal;

fixably coupling the plurality of cam lobes with a retraction sleeve and a trigger;

slidably externally coupling the retraction sleeve and trigger to the cable;

slidably externally coupling a plurality of independent sleeves to the cable between the trigger and plurality of cam lobes and configuring the plurality of independent sleeves to slidably couple over the retraction sleeve, wherein the plurality of independent sleeves each include an at least partial conical external surface and an at least partial conical internal recess;

orienting the plurality of independent sleeves such that a narrower external side of each of the plurality of independent sleeves is adjacent to the wider internal recess side of the adjacent independent sleeve;

translating the trigger away from the head member with respect to the cable causing the retraction sleeve to translate with respect to the cable; and rotating the plurality of cam lobes from the extended state to the retracted state.

15. The method of claim 14, wherein the act of slidably externally coupling a plurality of independent sleeves to the cable includes configuring the plurality of independent sleeves to substantially cover the retraction sleeve.

16. The method of claim 14, wherein the act of slidably externally coupling a plurality of independent sleeves to the cable includes configuring the plurality of independent sleeves to adjacently internest with one another.

17. The method of claim 16, wherein configuring the plurality of independent sleeves to adjacently internest with one another includes adjacently orienting a conically small lengthwise end with a conically large lengthwise end of the each of the plurality of independent sleeves.

18. The method of claim 16, wherein configuring the plurality of independent sleeves to adjacently internest with one another includes overlapping adjacent sleeves at least 5%.

19. The method of claim 16, wherein configuring the plurality of independent sleeves to adjacently internest with one another includes overlapping at an adjacent sleeve lengthwise orientation angle up to 45 degrees.

20. The method of claim 16, wherein configuring the plurality of independent sleeves to adjacently internest with one another includes a ball and socket configuration including a partially spherically shaped external surface on one end of each sleeve internested within a partially spherical recess within an adjacent independent sleeve.

* * * * *